US009254895B2

(12) United States Patent
Choi

(10) Patent No.: US 9,254,895 B2
(45) Date of Patent: Feb. 9, 2016

(54) WATER BICYCLE AND WATER BICYCLE DRIVE HOUSING

(71) Applicant: Hyunjin Leports Co., Ltd., Chuncheon (KR)

(72) Inventor: Jin Wook Choi, Chuncheon (KR)

(73) Assignee: Hyunjin Leports Co., Ltd., Chuncheon (KR)

( * ) Notice: Subject to any disclaimer, the term of this patent is extended or adjusted under 35 U.S.C. 154(b) by 0 days.

(21) Appl. No.: 14/677,807

(22) Filed: Apr. 2, 2015

(65) Prior Publication Data

US 2015/0210364 A1 Jul. 30, 2015

Related U.S. Application Data

(63) Continuation of application No. PCT/KR2013/008608, filed on Sep. 26, 2013.

(30) Foreign Application Priority Data

Oct. 2, 2012 (KR) ..... 10-2012-0109652
Oct. 12, 2012 (KR) ..... 10-2012-0113625

(51) Int. Cl.
*B63H 16/20* (2006.01)
*B63B 35/74* (2006.01)
*B63B 35/73* (2006.01)
(Continued)

(52) U.S. Cl.
CPC ..... *B63B 35/74* (2013.01); *B63B 1/125* (2013.01); *B63B 35/73* (2013.01); *B63H 1/14* (2013.01); *B63H 5/1252* (2013.01); *B63H 16/20* (2013.01); *B63H 21/20* (2013.01); *B63H 23/02* (2013.01); *B63H 25/02* (2013.01); *B63H 25/38* (2013.01); *B63B 1/12* (2013.01); *B63B 2003/145* (2013.01); *B63B 2035/715* (2013.01); *B63H 16/14* (2013.01); *B63H 2016/202* (2013.01); *B63H 2023/0216* (2013.01); *B63H 2023/0233* (2013.01); *B63H 2025/024* (2013.01)

(58) Field of Classification Search
USPC ..... 440/3, 26, 30
IPC ..... B36H 16/12,2016/202; B63B 35/74
See application file for complete search history.

(56) References Cited

U.S. PATENT DOCUMENTS 2,990,804 A * 7/1961 Garehime ..... B63B 7/06 114/283
5,308,268 A * 5/1994 Schmid ..... B63H 16/14 114/362

(Continued)

FOREIGN PATENT DOCUMENTS

JP 06-127471 A 5/1994

*Primary Examiner* — Stephen Avila
(74) *Attorney, Agent, or Firm* — Perkins Coie LLP

(57) ABSTRACT

A water bike using a floating bodies and a driving housing is provided. Some implementations of the disclosed technology provide the water bike including a plurality of floating bodies each of which has a spherical shape or a sphere-like shape and disposed at front and rear sides of the water bike, connection rods that are attached to or detached from the floating bodies at positions toward centers of the floating bodies, a body frame for connecting the plurality of floating bodies to one another, a driver chair disposed over the body frame, handles configured to manipulate a moving direction and connected to a rudder that is disposed at a rear side of the water bike, and pedals disposed on the body frame adjacent to the floating body that is disposed at the front side to provide a driving force.

18 Claims, 9 Drawing Sheets

(51) Int. Cl.

| | |
|---|---|
| ***B63H 23/02*** | (2006.01) |
| ***B63H 1/14*** | (2006.01) |
| ***B63H 5/125*** | (2006.01) |
| ***B63H 21/20*** | (2006.01) |
| ***B63H 25/02*** | (2006.01) |
| ***B63H 25/38*** | (2006.01) |
| *B63H 16/08* | (2006.01) |
| *B63B 1/12* | (2006.01) |
| *B63B 35/71* | (2006.01) |
| *B63B 3/14* | (2006.01) |

(56) References Cited

U.S. PATENT DOCUMENTS 5,316,508 A * 5/1994 Landucci ..... B63H 16/14 114/144 R
5,362,264 A * 11/1994 Parant ..... B63B 35/795 440/29
5,374,206 A * 12/1994 Gregory ..... B63H 16/14 440/27
5,415,574 A * 5/1995 Siviero ..... B63H 21/175 440/12
5,626,501 A 5/1997 He
5,651,706 A 7/1997 Kasper
6,146,218 A 11/2000 White
6,311,632 B1 * 11/2001 Noel, Jr. ..... B63B 7/04 114/61.1
6,712,653 B2 * 3/2004 Free ..... B63H 16/14 440/27
6,869,323 B2 * 3/2005 Norman ..... B63B 7/04 440/21
2012/0149517 A1 * 6/2012 Ko ..... B63M 6/65 475/5

* cited by examiner

WATER BICYCLE AND WATER BICYCLE DRIVE HOUSING

PRIORITY CLAIMS AND CROSS-REFERENCE TO RELATED APPLICATION

This patent document is a continuation in part application claiming priority under 35 U.S.C. §§120 and 365 (c) to International Application No. PCT/KR2013/008608 entitled "WATER BICYCLE AND WATER BICYCLE DRIVE HOUSING" filed with the Korean Intellectual Property Office (KIPO) on Sep. 26, 2013, which further claims the benefit of priority to Korean Patent Application No. 10-2012-0109652 filed on Oct. 2, 2012 and Korean Patent Application No. 10-2012-0113625 filed on Oct. 12, 2012. The entire disclosures of the above applications are incorporated by reference as part of this document.

TECHNICAL FIELD

This patent document relates to a water bike including water bike that is capable of being safely and stably driven for enjoying leisure sports.

BACKGROUND

The improvements in standards of living and desire for cultural needs have been motivated to various leisure and sports. Most of all, land sports definitely catch popularity. For example, there are various popularized athletic sports, fitness, cycling, and hiking because the land sports have good accessibility and safety, as well as, equipment for the land sports may be easily equipped. Also, water sports are in the limelight. However, the water sports are limited in accessibility and safety, and equipment for the water sports is expensive and difficult in handling, and thus the water sports have not been widely enjoyed in comparison to the land sports.

For example, in case of rafting that uses an inflatable rubber boat to shoot down a rapid stream, since there are few valleys, only some enthusiasts enjoy the rafting. Also, in case of water-ski or yacht, equipment for the water-ski or yacht is expensive, and thus it has low accessibility. Also, ordinary people may not enjoy the water-ski or yacht with their families due to safety problem.

SUMMARY

Various implementations of the disclosed technology provide a water bike having an improved structure so as to popularize water sports. The water bike has a safely and stably drivable structure under a water environment in which water rapidly flows or waves exist in consideration of the environment in which the water bike is used.

To enjoy e water sports, a user may want to look not only at the water but also at the surrounding environment. Some implementations of the disclosed technologies provide a water bike that is capable of allowing a user to leisurely look at a surrounding scenery to enhance the users enjoyment of the water sports.

Some implementations of the disclosed technology provide a water bike of which a direction is easily adjusted with a stable structure when the user drives the water bike while looking ahead.

Some implementations of the disclosed technology provide a water bike which allows to user select manual driving or automatic driving. Further, some implementations of the disclosed technology provide a speed shifting function by simply installing a power assembly. In some implementations, the power assembly is realized by a housing in which a motor or transmission is built-in and a bevel gear integrated Thus, it is possible to reduce manufacturing costs.

In one aspect, a water bike using a floating body is provided to include: a plurality of floating bodies each of which has a spherical shape or a sphere-like shape, wherein one of the plurality of floating bodies is disposed at a front side of the water bike in a forward advancing direction of the water bike, and two of the plurality of floating bodies are disposed at a rear side of the water bike; a body frame configured to connect the plurality of floating bodies to one another, wherein the body frame connects the plurality of floating bodies by using three connection rods that are respectively attached to or detached from the floating bodies along a direction toward centers of the plurality of floating bodies; a driver chair disposed over the body frame; handles configured to manipulate a moving direction of the water bike and connected to a rudder that is disposed at a rear side of the water bike; pedals disposed on the body frame adjacent to the floating body that is disposed at the front side to provide a driving force so that the water bike move forward; a cylindrical housing including a motor and disposed under the driver chair and over the body frame; and a power transmission assembly for rotating a screw propeller that is disposed under the body frame in the water by using a driving force generated by the pedals or the motor, wherein the power transmission assembly rotates the screw propeller through a bevel gear that is coupled to and engaged with an input gear arranged on a circumference portion of the cylindrical housing.

In some implementations, the connection rods of the body frame are attached to or detached from the floating bodies by a screw-rotation. In some implementations, wherein the driver chair is disposed over the body frame on a line that intersects a center (Q) of a virtual line connecting centers of the two floating bodies disposed at the rear side, and the driver chair is disposed adjacent to the rear side of the body frame. In some implementations, the handles that are respectively positioned at left and right sides with respect to the driver chair are connected to a rotation member that rotates on a surface of a chair rod supporting the driver chair. In some implementations, the circumference portion has a circular wing shape. In some implementations, the cylindrical housing includes a metal member.

In another aspect, a water bike using a floating body is provided to include: a plurality of floating bodies each of which has a spherical shape or a sphere-like shape, wherein one of the plurality of floating bodies is disposed at a front side of the water bike in a forward advancing direction of the water bike, and two of the plurality of floating bodies are disposed at a rear side of the water bike; a body frame configured to connect the plurality of floating bodies one another, wherein the body frame connects the plurality of floating bodies by using three connection rods that are respectively attached to or detached from the floating bodies along a direction toward centers of the plurality of floating bodies; a driver chair disposed over the body frame; handles configured to manipulate a moving direction of the water bike and connected to a rudder that is disposed at a rear side of the water bike; pedals disposed on the body frame adjacent to the floating body that is disposed at the front side to provide a driving force so that the water bike moves forward; a cylindrical housing including a transmission and disposed under the driver chair and on the body frame; and a power transmission assembly for rotating a screw propeller that is disposed under the body frame in the water by using a driving force generated by rotation of the pedals or rotation of a motor, wherein the power transmission assembly rotates the screw propeller through a bevel gear that is coupled to and engaged with an input gear arranged on a circumference portion of the cylindrical housing.

In some implementations, the circumference portion has a circular wing shape. In some implementations, the cylindrical housing includes a metal member.

In another aspect, a driving housing disposed over a water bike is provided to include: a cylindrical housing body in which a motor is disposed such that the driving housing functions as a motor housing; a belt pulley around which a driving belt is wound, the belt pulley being integrated with the housing body; and a circular wing integrated with the housing body, the circular wing having a diameter from a central line of the housing body in a longitudinal direction to an outer circumferential end of the circular wing, the diameter being greater than that from the central line to an outer surface of the housing body, wherein the circular wing radially protrudes from a surface of the housing body in a predetermined distance, and the circular wing includes an input gear that is tooth-coupled to an output gear disposed under the circular wing to constitute a bevel gear.

In some implementations, the input gear of the circular wing is disposed toward the housing body and the belt pulley is disposed at a side opposite to the input gear of the circular wing. In some implementations, the input gear of the circular wing is disposed toward the housing body, and the housing body is disposed between the circular wing and the belt pulley. In some implementations, the output gear that is tooth-coupled to the input gear of the circular wing is connected to a screw propeller of the water bike through a flexible shaft. In some implementations, the water bike is automatically driven by a rotation force of the motor in the housing body or manually driven by a rotation force that is generated by rotation of pedals disposed at a front side of the water bike and transmitted through the driving belt that is wound around the belt pulley.

In another aspect, a driving housing disposed over a water bike is provided to include: a cylindrical housing body in which a transmission is disposed such that the driving housing functions as a transmission housing; a belt pulley around which a driving belt is wound, the belt pulley being integrated with the housing body; and a circular wing integrated with the housing body, the circular wing having a diameter from a central line of the housing body in a longitudinal direction to an outer circumferential end of the circular wing, the diameter being greater than that from the central line to an outer surface of the housing body, wherein the circular wing radially protrudes from a surface of the housing body in a predetermined distance, and the circular wing includes an input gear that is tooth-coupled to an output gear disposed under the circular wing to form a bevel gear.

In some implementations, the input gear of the circular wing is disposed toward the housing body, and the belt pulley is disposed at a side opposite to the input gear of the circular wing. In some implementations, the input gear of the circular wing is disposed toward the housing body, and the housing body is disposed between the circular wing and the belt pulley. In some implementations, the output gear that is tooth-coupled to the input gear of the circular wing is connected to a screw propeller of the water bike through a flexible shaft.

According to some implementations of the water bike disclosed in this patent document, since the water bike is easily driven and can have improved stability and safety even in an environment where there are rapid stream and waves exist, in comparison to the conventional water bikes. Furthermore, in some implementations, since the units for adjusting the direction are disposed in the relatively rear side of the water bike, the driver may enjoy the water leisure and sports while enjoying the scenery in front of the water bike.

In some implementations, since the driving housing of which the motor or transmission is integrated with the bevel gear is disposed on the water bike, the motor and the bevel gears do not need to be separately installed. Thus, costs for manufacturing the water bike may be reduced, and the water bike can be driven in various environments.

Meanwhile, effects that are expected by technical characteristics of the disclosed technology in this patent document and potential effects may be construed as the effects that are described in this patent document even if such effects are not described herein.

Figure 1:
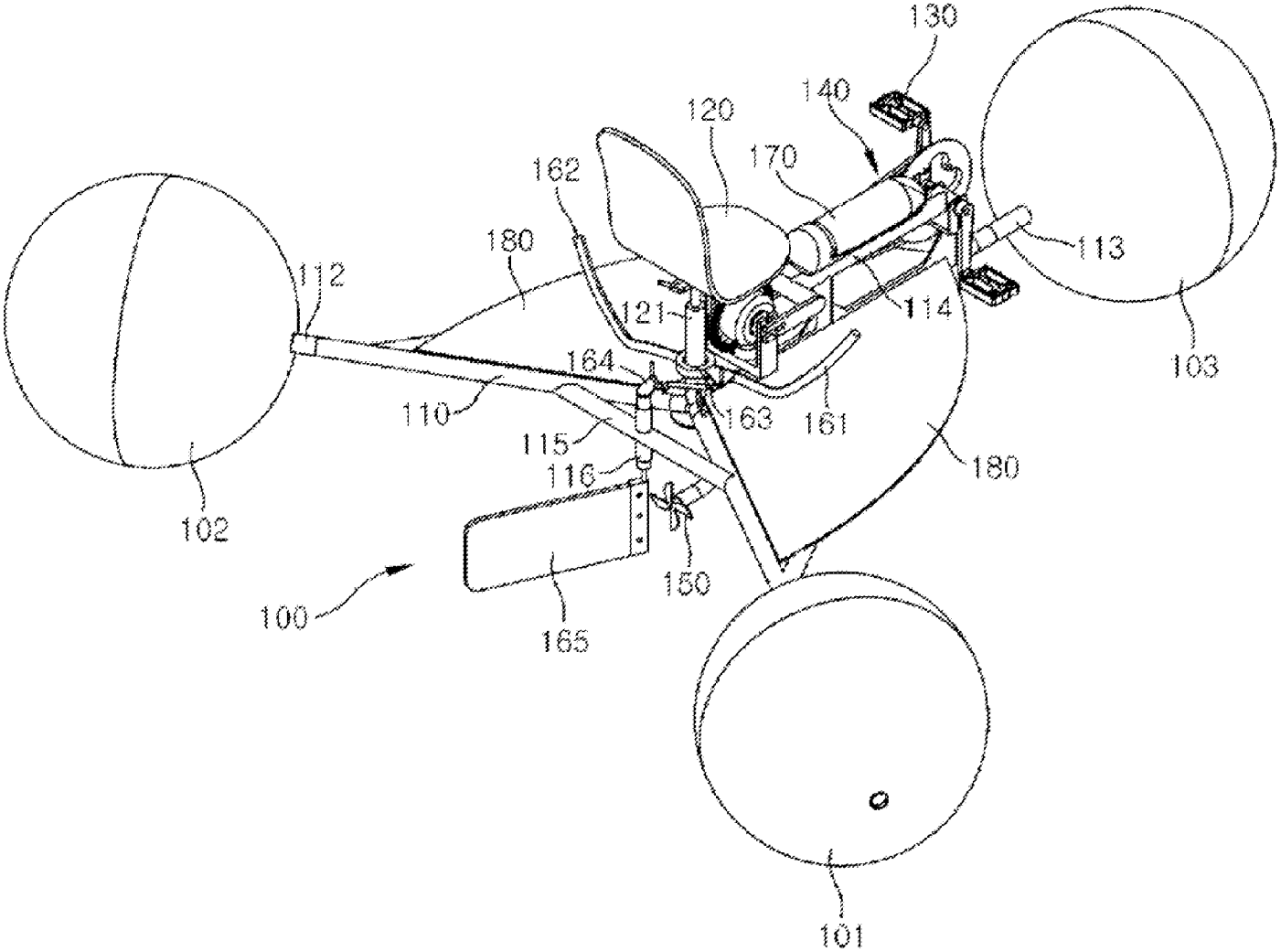
FIG. 1 is a perfective view of a water bike 100 according to an embodiment of the disclosed technology.

The accompanying drawings are exemplified as references for understand with respect to implementations of the disclosed technology, and the scope of the disclosed technology will not be limited by the drawings.

DETAILED DESCRIPTION

In order to popularize water sports, water sports need to be provided safely and easily so that ordinary people can enjoy. Also, high accessibility is desirable. In Korea, there are rivers or lakes which have a depth of about 30 cm or more instead of rapid stream. Also, there is an environmental limitation to enjoy water-ski or yacht. In this circumstance, a water bike may be considered as the water sport that is capable of being safely enjoyed on most of the rivers and lakes.

For example, a water bike for water sport is disclosed in Korean Utility Gazette No. 1989-0002221. The water bike has three spherical floating bodies and obtains a driving force for propulsion by using a bike-type chain. However, since the water bike has a structure in which a pedal 11 gets into water, a driver may have extreme physical fatigue every time he presses pedals due to resistance of the water. Also, since a body frame is coupled to an upper end of each of the spherical floating bodies 3, the water bike has a serious structural issue regarding stability. For example, if the water rapidly flows or there are waves, it becomes very difficult to drive the water bike. Moreover, since the water bike according to the related art has to be driven in a state where the driver excessively leans himself or herself forward the spherical floating body located at a front side, it is difficult for the driver to look around the surrounding scenery. Thus, the water bike didn't become popular enough.

Meanwhile, the water bike has a power transmission system for transmitting a power generated on the water to a screw propeller in the water. To effectively use the power transmission system, in general, a bevel gear in which two axes are vertically engaged with each other is adopted. However, the system in which the power generated from the pedals is transmitted to the screw propeller through the bevel gear may cause a limitation in which the driving of the water bike relies on a force of the driver (a force for turning the pedals). People who enjoy the sports want various experiences. Someone that uses the water bike may want to drive the water bike while generating the power by his own effort. Someone may want to drive while receiving help from a motor or transmission rather than using all his force. For the latter, the motor or transmission needs to be provided in the water bike.

All components of the water bike may be affected by the water. For example, when the motor is installed, waterproofing is significantly considered. If the motor is used in the power transmission system, a housing for the motor needs to be provided and a bevel gear for transmitting the power to the screw propeller in the water by using the power of the motor needs to be installed. Thus, the structure of the water bike becomes more complicated as compared to the land bike. Also, when the motor and the bevel gear are separately installed to be connected to each other, it takes a lot of time and efforts to manufacture the water bike, and thus manufacturing costs increase.

Hereinafter, detailed descriptions will be described below in more detail with reference to the accompanying drawings. Moreover, detailed descriptions related to well-known functions or configurations will be ruled out in order not to unnecessarily obscure subject matters of the disclosed technology.

FIG. 1 is a view an exemplary water bike 100 according to an embodiment of the disclosed technology. Since the water bike 100 has to float on water, the water bike 100 includes a plurality of floating bodies 101, 102, and 103 that are formed of or includes a foam material that floats on the water. Also, connection rods 111, 112, and 113 of a body frame 110 are respectively coupled to the floating bodies 101, 102, and 103. A driver chair 120, pedals 130, a power transmission assembly 140, and handles 161 and 162 are disposed on the body frame 110. Also, a screw propeller 150 and a rudder 165 are disposed under the body frame 110 in the water. A panel 180 may be disposed at left and right sides of the body frame 110 for convenience of driver.

Figure 2:
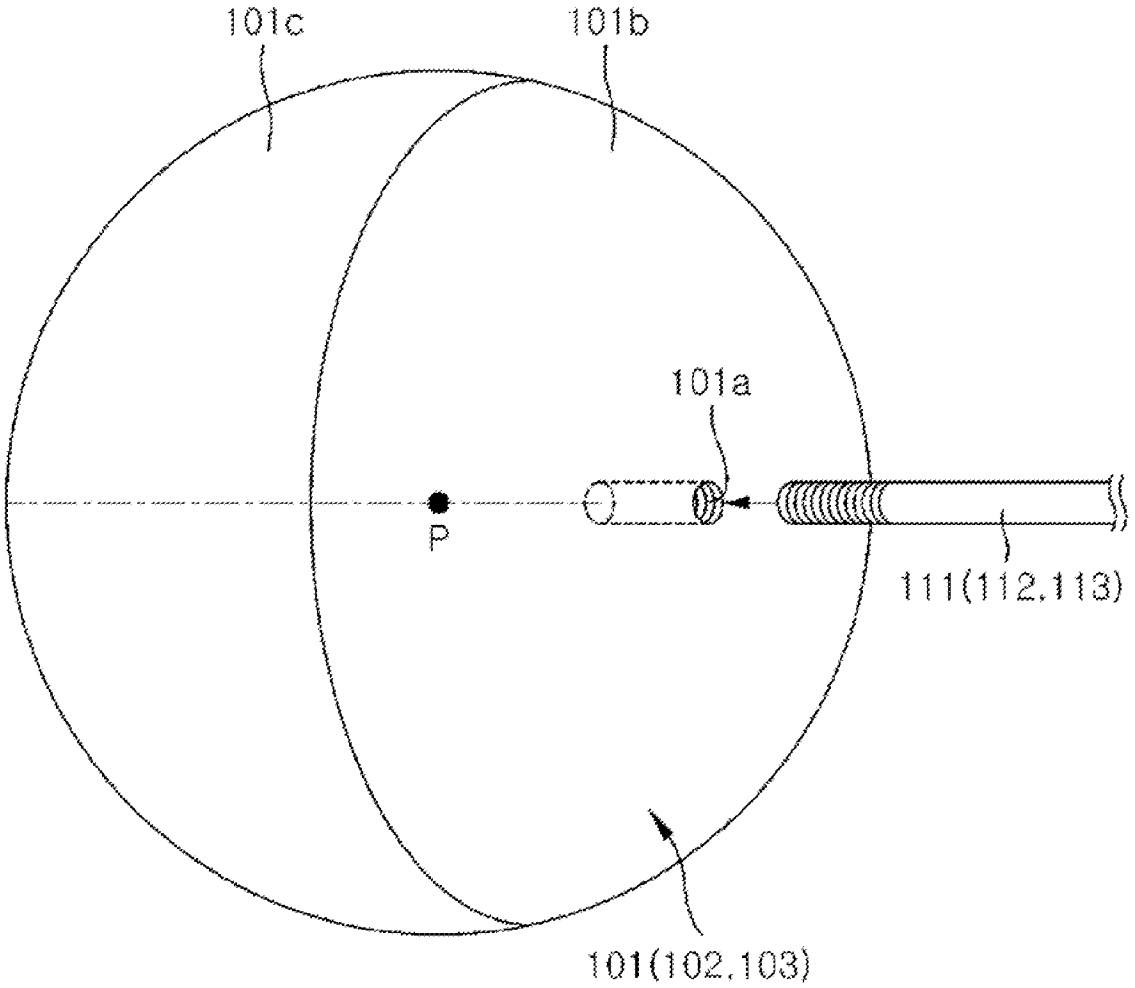
FIG. 2 is a view illustrating a position at which a floating body 101 is coupled to a connection rod of a body frame according to an embodiment of the disclosed technology (a coupling hole 101*a* may have a predetermined depth to a center P of the floating body 101 or a depth that passes through the center P of the floating body 101 to an opposite side to define an opposite opening, and an opening cap may be provided).

FIG. 2 is a view of an exemplary structure in which the floating body 101 is coupled to or separated from the connection rod 111. Similarly, the rest of the floating bodies 102 and 103 may be coupled to or separated from the connection rods 112 and 113 as illustrated in FIG. 2. A coupling hole 101*a* is defined in the floating body 101 toward a center P of the floating body 101. The body frame 101 may be connected to the floating body 101 by screw-coupling an end of the connection rod 111 of the body frame 101 into the coupling hole 101*a* of the floating body 101.

The coupling and separation between the body frame 110 and the floating bodies 101, 102, and 103 may be modified in various manners. In some implementations, the connection rods 111, 112, and 113 face toward the centers P of the floating bodies 101, 102, and 103 when the connection rods 111, 112, and 113 are coupled to the floating bodies 101, 102, and 103. Since a direction of a groove of the coupling hole 101*a* faces toward the center P, the connection rods 111, 112, and 113 may be respectively coupled to the floating bodies 101, 102, and 103 at positions toward the centers P. Thus, the water bike 100 may secure stability of the body frame 110, and the floating body may be more easily firmly connected to the body frame.

In some implementations, the floating body may have a spherical shape as illustrated in FIGS. 1 and 2. However, in another embodiment, the floating body may have other geometric shape such as a shape having an oval section instead of the spherical shape. In the present disclosure, a three-dimensional shape that does not have a perfect spherical shape but has a curved section may be defined as a "sphere-like shape".

Figure 3:
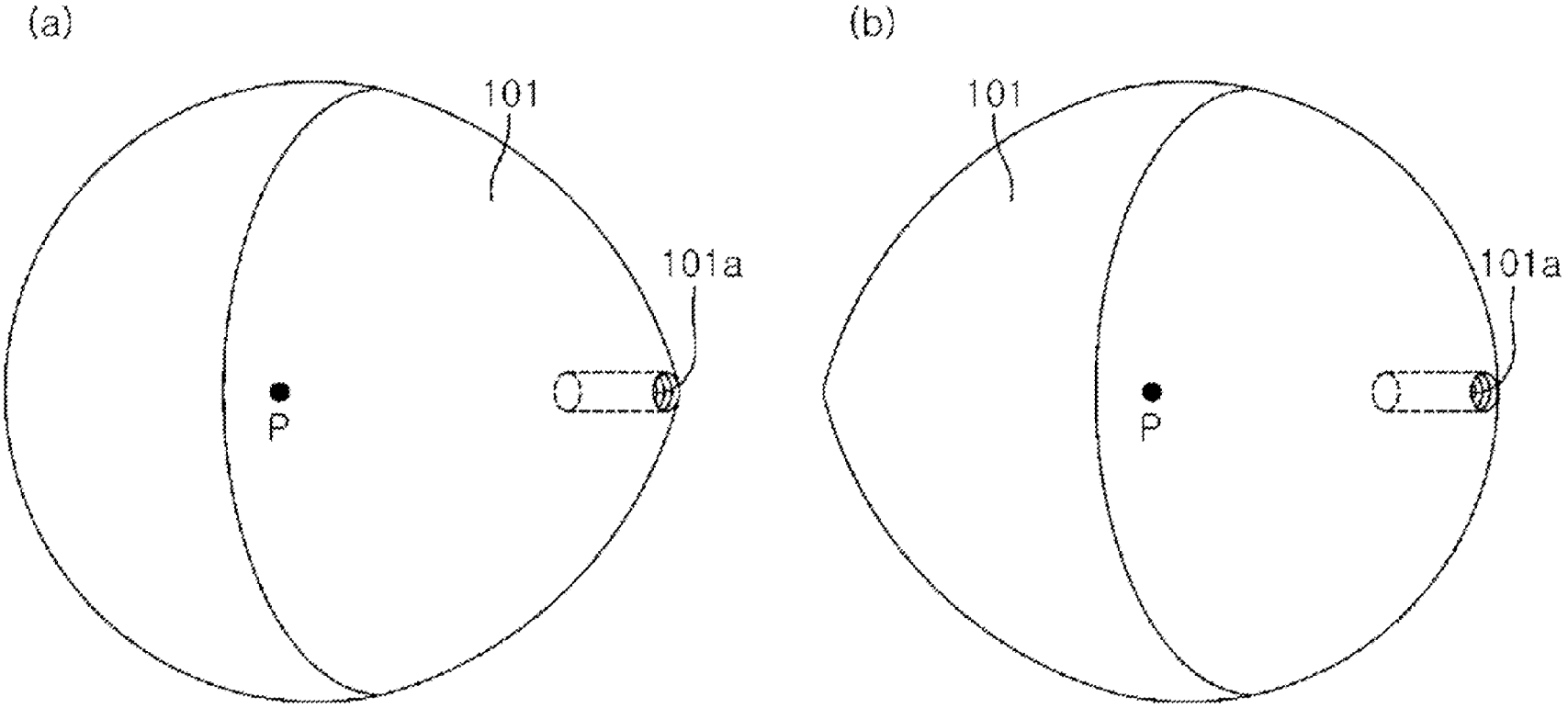
FIG. 3 is a view illustrating a modified example of the floating body 101.

An example of the sphere-like shape is illustrated in FIG. 3. FIGS. 3A and 3B are views illustrating an example of the floating body 101 having a sphere-like shape. As illustrated in FIG. 3A, in some implementations, the floating body 101 may have a stream shape at a side at which the coupling hole 101*a* is defined. Alternatively, as illustrated in FIG. 3B, the floating body 101 may have a spherical shape at a side at which the coupling hole 101*a* is defined. In some implementations, the groove of the coupling hole 101*a* in the floating body may face toward the center P. When the floating body 101 is viewed from a front side, the connection rods 111, 112, and 113 may be coupled to the floating bodies at a lateral side to secure stability and coupling ability of the water bike. The body frame 110 may be coupled to the floating bodies 101, 102, and 103 to prevent the water bike 100 from being easily fell down even if the water rapidly flows or waves exist.

In some implementations, the floating body 101 of the disclosed technology may be separated into two parts 101*b* and 101*c*. The floating body 101 may screw rotate in a clockwise or counterclockwise direction to separate the floating body 101 into two parts 101*b* and 101*c*, thereby reducing a volume thereof and improving convenience of movement.

In some implementations, the water bike 100 has the plurality of floating bodies. As illustrated in FIG. 1, in some implementations, one floating body 101 may be disposed at a front side, and two floating bodies 102 and 103 may be disposed at a rear side. When the floating bodies are connected to each other, a triangle shape may be formed.

Figure 4:
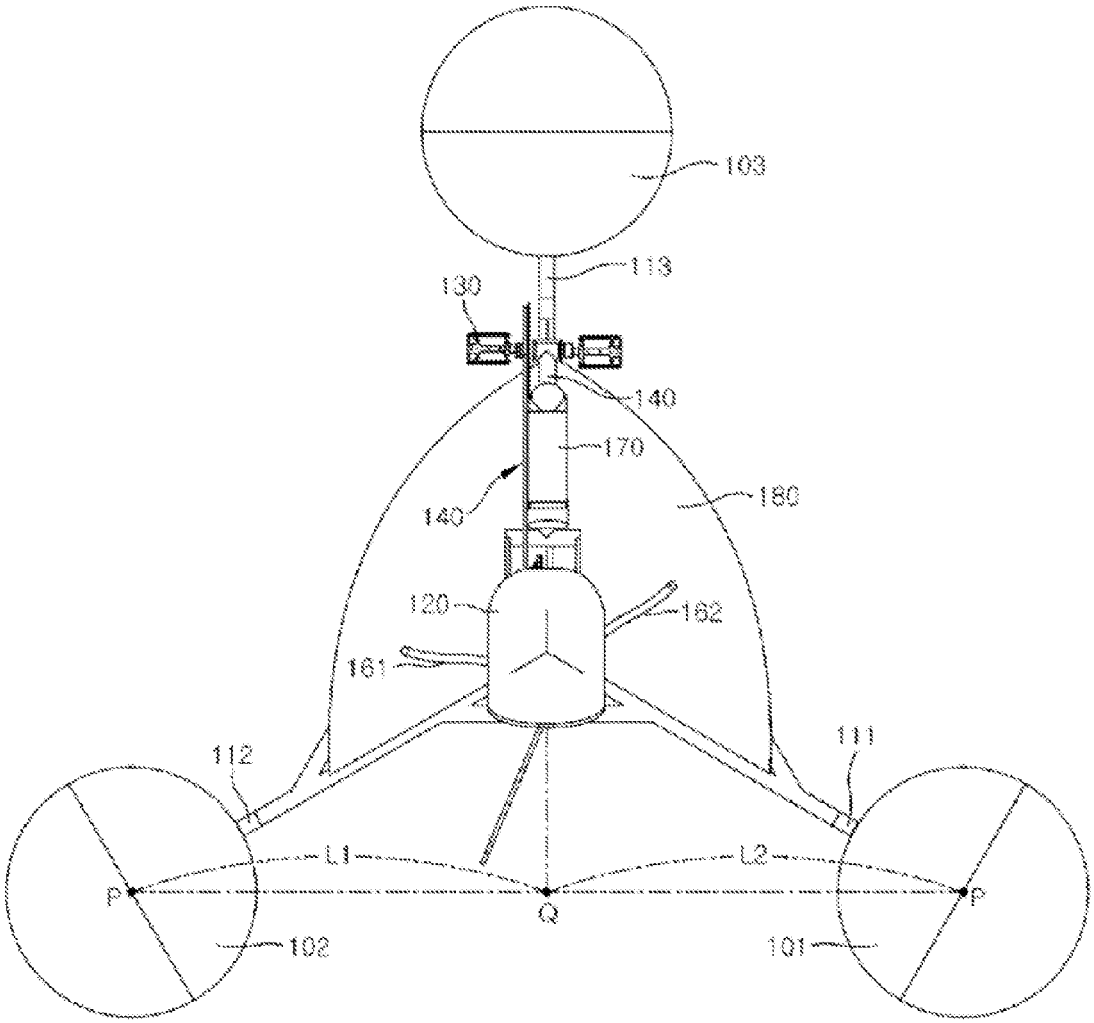
FIG. 4 is a view of the water bike 100 when viewed from above according to an embodiment of the disclosed technology.

FIG. 4 is a plan view of an exemplary water bike of the disclosed technology. The body frame (see reference numeral 110 of FIG. 1) of the disclosed technology may have a connection structure in which components that respectively connect the floating bodies 101, 102, and 103 to the connection rods 111, 112, and 113 on the same plane are disposed in an upside down "Y" shape. The panel 180 is disposed on and coupled to the body frame 110. Although the body frame 110 has a frame structure in which the connection rods and support rods, which are provided with metal members or plastic members, are connected to each other in the upside down "Y" shape as illustrated, and the panel having an approximately triangle shape is coupled on the body frame, the body frame 110 may be variously changed in shape. For example, the body frame 110 may have a polygonal or circular geometric shape.

The driver chair 120 on which the driver seats may be connected to a chair rod (see reference numeral 121 of FIG. 1) that is disposed upright on or over the body frame 110. A height adjustment unit that is capable of appropriately adjusting a height of the driver chair 120 may be included. The driver chair 120 may be divided into a portion for supporting hips of the driver and a back portion as illustrated.

In some implementations, the driver chair 120 may be disposed at a rear side position on the body frame 110. As illustrated in FIG. 4, the driver chair 120 may be disposed in a line that intersects a center Q of a virtual line which connects the centers of the floating bodies 102 and 103 at the rear side to each other. Also, the position of the driver chair 120 may be disposed adjacent to the rear side of the body frame 110 rather than a center of the body frame 110. Since the driver chair 120 is disposed adjacent to the rear side of the body frame 110, while the driver leans his or her back in the driver chair 120 to drive the water bike, the driver can look forward and enjoy scenery view. For example, the driver may press down the pedals to drive the water bike by using his legs while looking forward in a statewhere the driver leans his back in the driver chair 120. Thus, the arrangement of the driver chair 120 allows the driver to keep his eyes forward and secure a sufficient available space.

Referring to FIGS. 1 and 4, the handles 161 and 162 are disposed at both left and right sides of the driver chair 120. The handles 161 and 162 may be disposed on a position at which the driver adjusts the handles 161 and 162 in a state where the driver seats on the driver chair 120. In some implementations, each of the handles 161 and 162 may have a rod shape that has a curve distinguished into a horizontal component and a vertical component in a forward slanted direction. The driver may grasp the vertical component of the handle, i.e., a portion protruding upward from the bottom side to drive the water bike 100. The handles 161 and 162 may be moved and manipulated at left and right sides. Thus, ends of the handles 161 and 162 may be connected to each other by a rotation member 163 for rotating the handles 161 and 162 on a surface of the chair rod 121.

The rudder 165 may be connected to a lower end of a connection member 116 passing through a center of a rear support rod 115 at the rear side of the body frame 110. The rudder 165 may be connected to the rotation member 163 via the connection member 116. The rudder 165 may be connected to the rotation member 163 for securing manipulation of the handles 161 and 162 by a rotation medium 164. The rotation medium 164 may connect a protrusion of the rotation member 163 to a protrusion on an upper end of the connection member 116.

Thus, when the driver grasps the handles 161 and 162 to manipulate the handles 161 and 162 at left and right sides according to a traveling direction, the rudder in the water may rotate according to the rotation of the handles 161 and 162, and thus the driver may easily drive the water bike 100. In some implementations, the rudder is disposed toward the rear side of the water bike 100 in the water. This is done because the pair of handles 161 and 162 is connected to the driver chair 120 that is disposed at the rear side of the body frame 110.

At least one support set 114 may be disposed on the body frame 110. The power transmission assembly 140 and the left and right pedals 130 may be disposed on the support set 114. Also, a battery 170 that is required to drive the water bike by the motor may be disposed on the support set 114.

Figure 5:
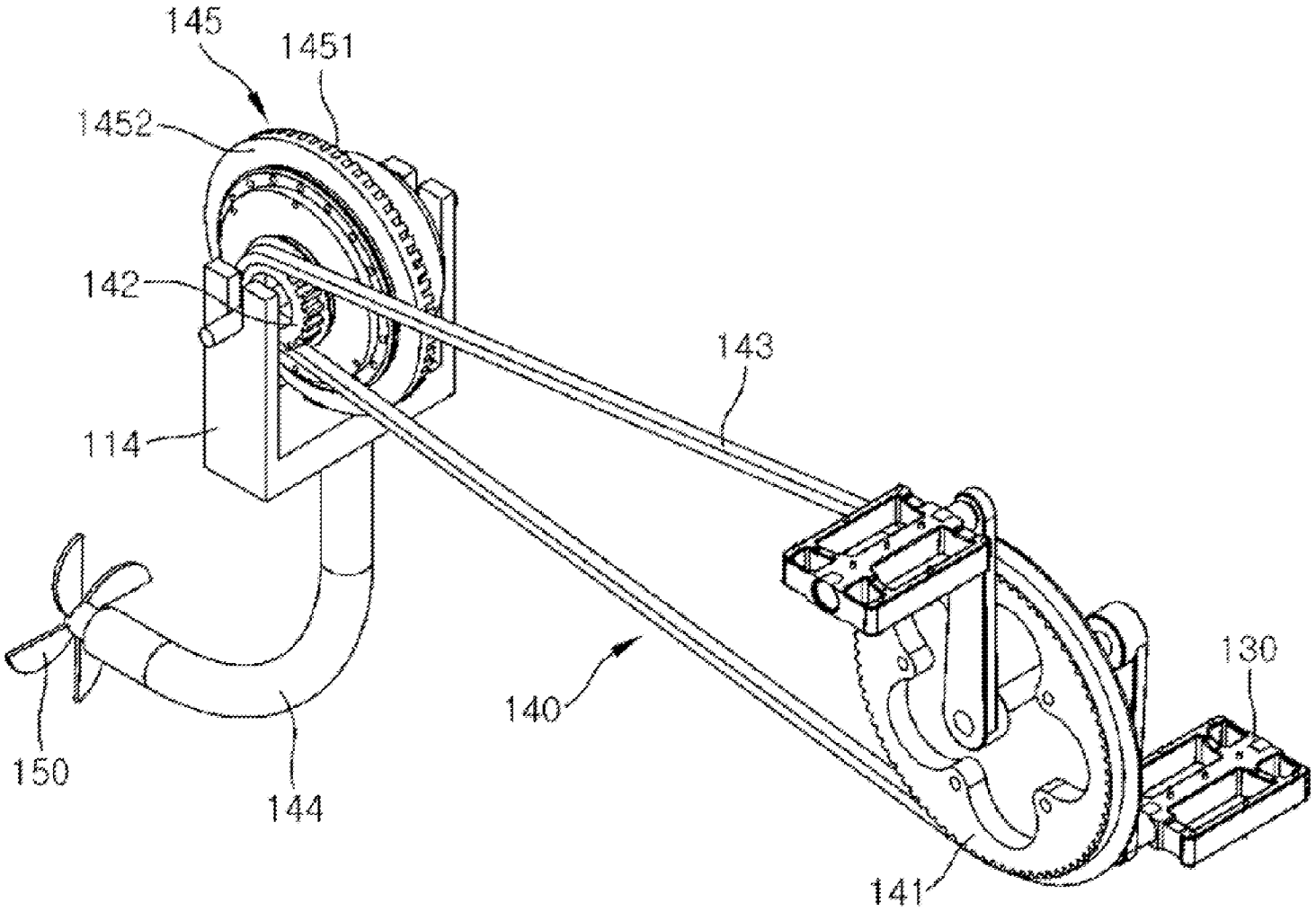
FIGS. 5 and 6 are perspective views illustrating an exemplary power transmission assembly 140 of the water bike according to an embodiment of the disclosed technology.
Figure 6:
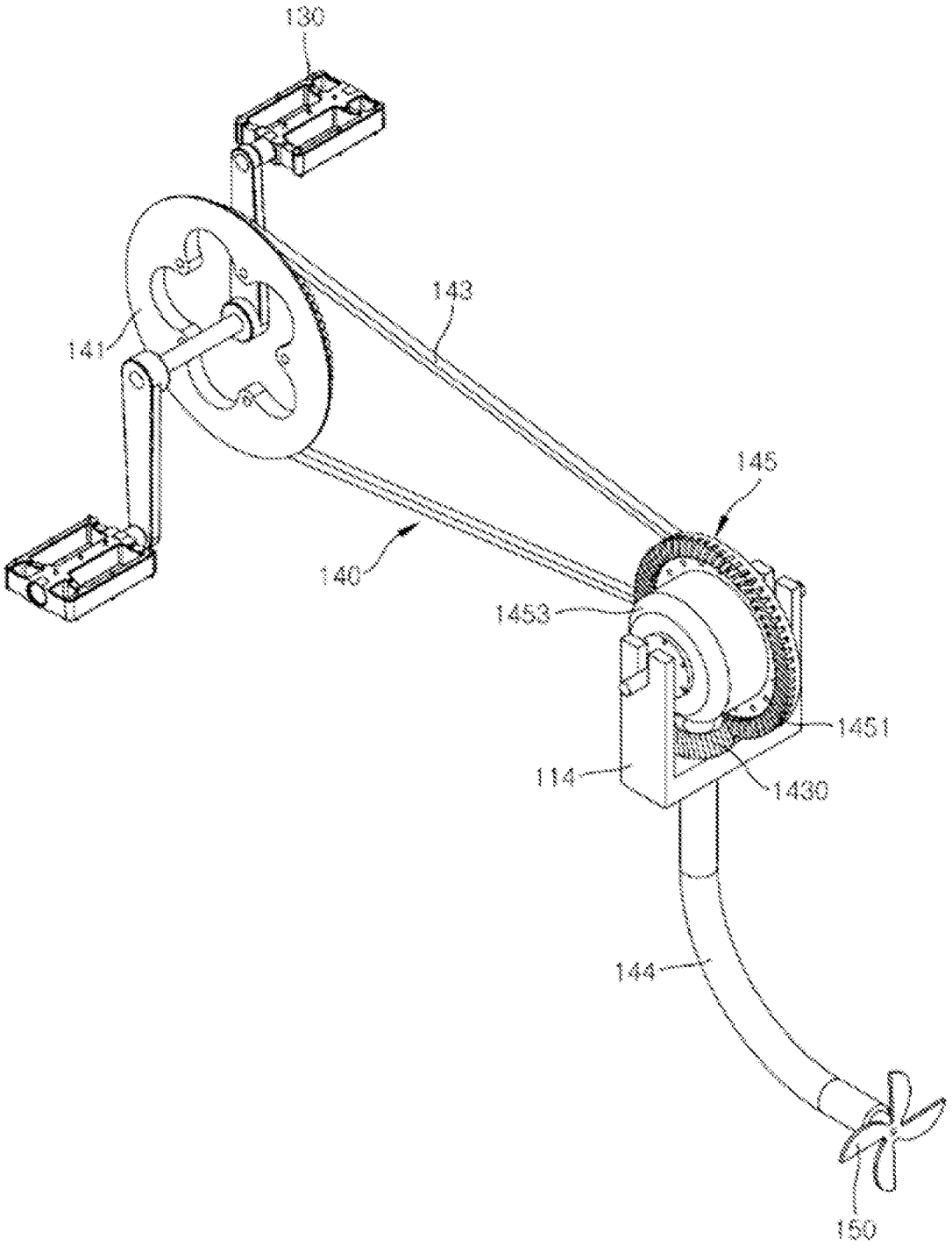

FIGS. 5 and 6 are schematic views illustrating an exemplary power transmission assembly 140 connected to the pair of left and right pedals 130 according to an embodiment of the disclosed technology. The support set 114 is illustrated in FIG. 5 for convenience of description.

A belt 143 is wound around a front pulley 141 and a rear pulley 142. Each of the front and rear pulleys 141 and 142 may have a gear shape having teeth. The belt 143 may be provided with a timing belt having teeth (not shown) on an inner circumferential surface thereof to transmit power between the front and rear pulleys 141 and 142.

The front pulley 141 rotates according to movement of the left and right pedals 130, and the rotation force of the front pulley 141 may be transmitted to the rear pulley 142 (see reference numeral 18 of FIG. 9) by the belt 143. Then, according to the rotation of the rear pulley 142, the driving housing 145 on which the rear pulley 142 is disposed rotates. Here, the rotation force of the driving housing 145 may rotate the screw propeller that is disposed in the water to transmit the power.

Hereinafter, a driving housing 10 of the water bike will be described with reference to FIGS. 7 to 9. The driving housing 10 corresponds to the driving housing 145 of FIG. 6, and a housing body 15 corresponds to a housing body 1453 of FIG. 6. Also, a circular wing 11 corresponds to a circular wing 1451 of FIG. 6, and an output gear 20 corresponds to an output gear 1430 of FIG. 6. Although the components are indicated by the different reference numerals from those in other figures, the functions of the components may be same from those in other figures.

Figure 7:
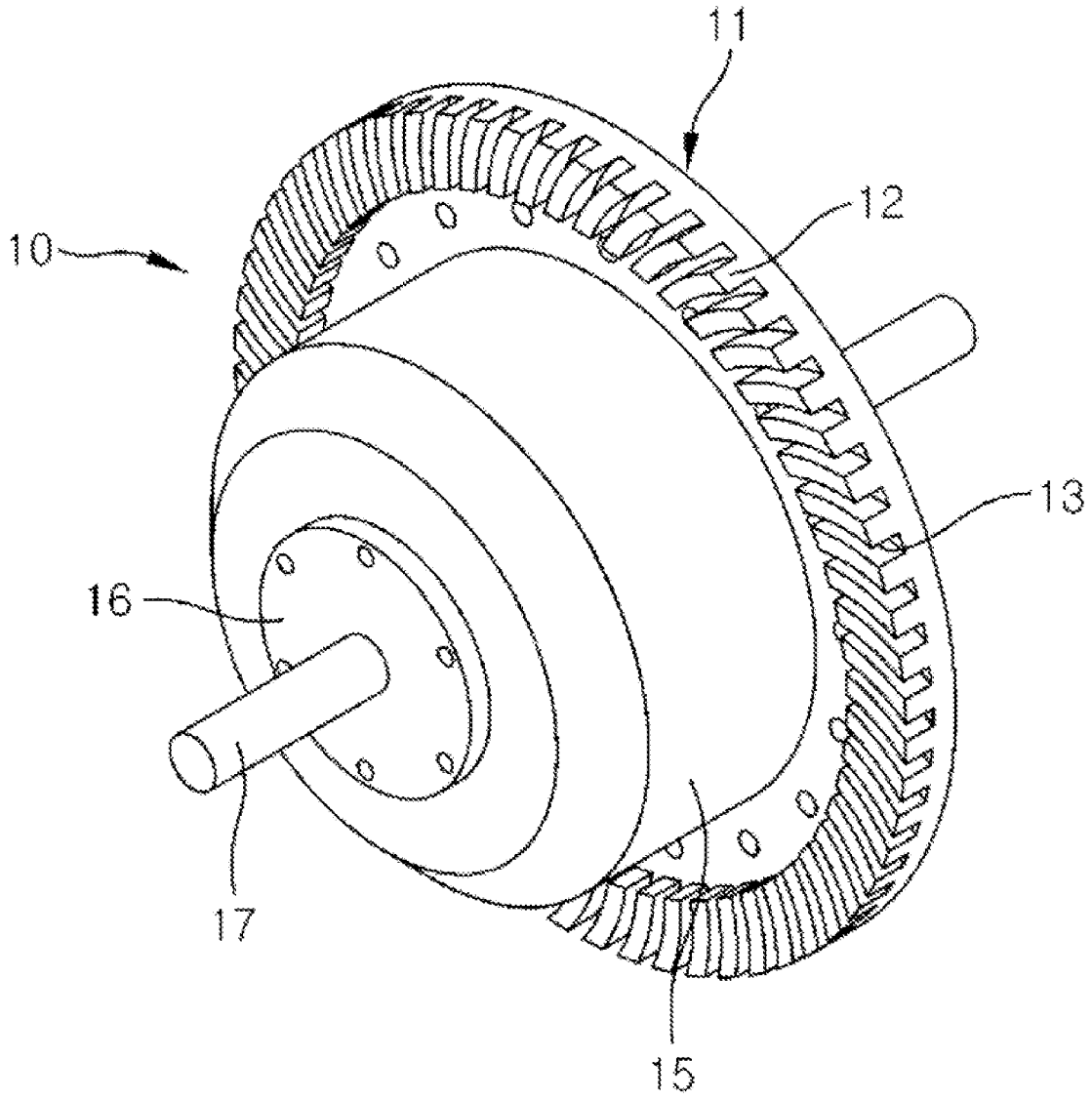
FIG. 7 is a perspective view of a driving housing 10 for water bike according to an embodiment of the disclosed technology.

FIG. 7 is a view illustrating an example of the driving housing 10 for water bike according to an embodiment of the disclosed technology. The driving housing 10 may have a cylindrical housing shape that is provided with a metal member. The driving housing 10 includes the housing body 15, the circular wing 11, and a belt pulley (reference numeral 18 of FIG. 9). The driving housing 10 may rotate with respect to a driving shaft 17. The components of the driving housing 10 are integrated with one another.

In some implementations, the driving housing 10 of the disclosed technology may be or include a motor housing. Thus, a motor element (not shown) may be built in the housing body 15. Also, in another implementation, the driving housing 10 of the disclosed technology may be or include a transmission housing. Thus, a transmission element (not shown) may be disposed in the housing body 15. The housing body 15 may be provided with the metal member and have a cylindrical shape having an accommodation space therein.

As illustrated in FIG. 7, the circular wing 11 having a diameter that is greater than that of the housing body 15 may be disposed at one end of the housing body 15. The circular wing 11 is integrated with the housing body 15. The housing body 15 may radially protrude from the circular wing 11 in a predetermined distance from an outer circumferential surface on one end of the circular wing 11. Here, a distance from a central line of the housing body 15 in a longitudinal direction to an outer circumferential surface of the housing body 15 may be less than that from the central line to an end of the outer circumference of the circular wing 11.

Input gears 12 and 13 having a repeated uneven shape may be formed on the outer circumference of the circular wing 11. The input gears 12 and 13 may be engaged with and tooth-coupled to the output gear (see reference numeral 20 of FIG. 8) that is disposed under the driving housing 10 to form a bevel gear.

In regards to the distance from the central line of the housing body 15 in the longitudinal direction to the end of the outer circumference of the circular wing 11, the circular wing 11 may have a diameter that is defined as a distance suitable for tooth-coupling the output gear 20 disposed under the circular wing 11 with the input gears of the circular wing 11. Detailed size and shape of the bevel gear may be variously changed, and thus the diameter of the circular wing 11 may be variously adjusted. A flange 16 may ensure that the housing body 15 is tightly coupled to the driving shaft 17.

In some implementations of the disclosed technology, the driving housing 10 is or includes a motor housing, and the circular wing 11 having the above-described structures is integrated with the driving housing 10. Also, in other implementations, the driving housing is or includes a transmission housing, and the circular wing 11 having the above-described structures is integrated with the driving housing 10. For example, a built-in transmission may be disposed in the housing body 15, and the belt pulley 18 may be attached to the built-in transmission.

Figure 8:
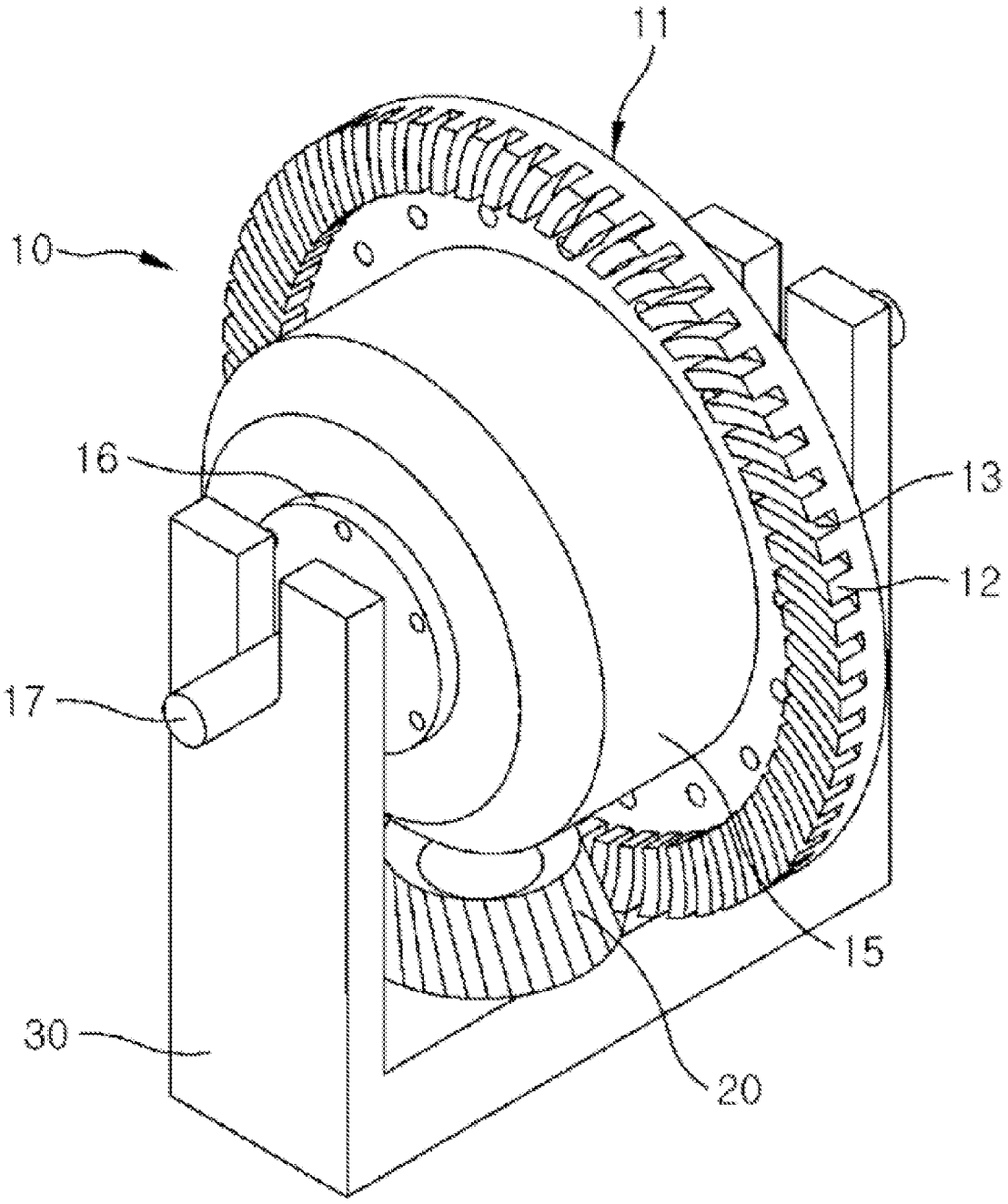
FIG. 8 is a view illustrating a state where the driving housing 10 of FIG. 7 is installed to a support 30 and engaged with an output gear 20.

See FIG. 8. FIG. 2 is a view showing an exemplary state in which the driving housing 10 is disposed on the support 30. The support 30 is a portion of the support set that is disposed on the water bike. As illustrated, the output gear 20 is disposed on the support 30 and under the housing body 15 of the driving housing 10 to form the bevel gear with the input gears 12 and 13 of the above-described circular wing 11. Although an uneven shape of the output gear is not illustrated in the drawings, the output gear substantially has an uneven shape so that the output gear is engaged with the input gears 12 and 13. Thus, when the input gears 12 and 13 rotates by a driving unit of the water bike, the output gear 20 engaged with the input gears 12 and 13 may rotate.

Figure 9:
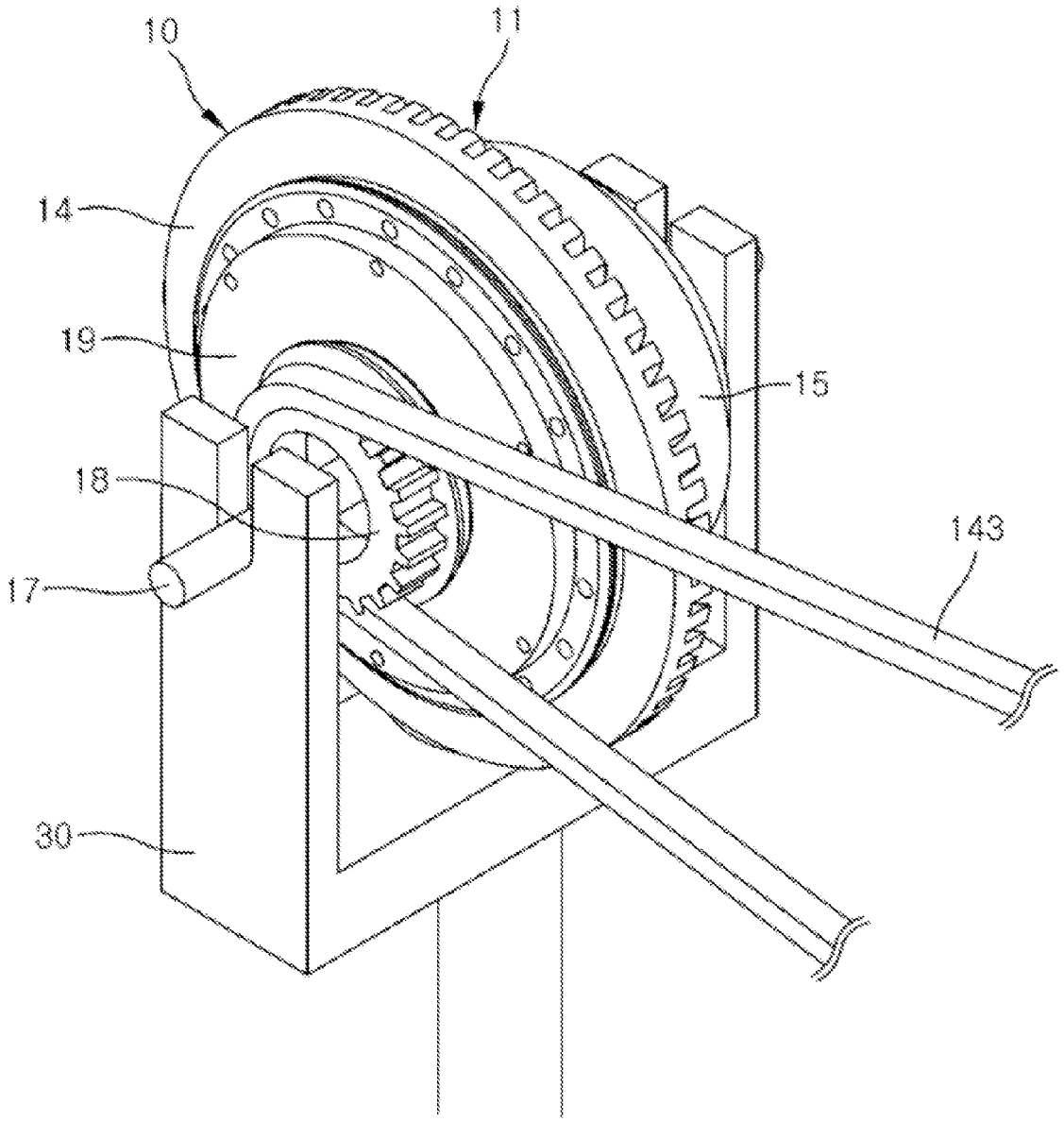
FIG. 9 is a view illustrating opposite side of FIG. 8, which show structures of a belt pulley 18 of the driving housing 10.

FIG. 9 is an exemplary view illustrating an opposite side of FIG. 8. An opposite surface 14 of the circular wing 11 may be or include a plane on which the gear does not exist. In this direction the belt pulley 18 having the uneven shape around which the driving belt 143 is wound may be disposed on the driving housing 10. In the driving housing 10 of the disclosed technology, the above-described housing body 15, the circular wing 11, and the belt pulley 18 are integrated with one another. The belt pulley 18 and the housing body 15 may be integrated with one another by the flange 19.

As discussed above, if the driving housing 10 according to some implementations of the disclosed technology is or includes a motor housing, the bevel gear is integrally disposed on the motor housing, and thus a function of the motor and a rotation force transmission function by the bevel gear may be achieved by one unit. The motor element disposed in the housing may not be affected by the water. Here, since it is unnecessary that the motor and the bevel gear are separately disposed, an installation space may be reduced, and efforts for installation may be also reduced. Various kinds and models of motors may be installed. In some implementations, a motor having a speed shifting function may be installed.

In another embodiment of the disclosed technology, if the driving housing 10 is a transmission housing, the bevel gear is integrally disposed on the transmission housing, and thus a function of the transmission and a rotation force transmission function by the bevel gear may be achieved by one unit. Here, since it is unnecessary that the transmission and the bevel gear are not separately disposed, an installation space may be reduced, and efforts for installation may be also reduced.

As illustrated in FIGS. 5 and 6, when the bevel gear (relationship between reference numerals 11 and 20) rotates, the screw propeller 150 rotates through a flexible shaft 144 connected to the output gear 20 to move forward the water bike. The flexible shaft 144 may be coupled to a bracket of the support set 114 and thus be connected to the output gear 20. The flexible shaft 144 may be curved to extend downward and rearward and thus be connected to the screw propeller 150.

The water bike may obtain power by rotating the screw propeller 150 disposed in the water. In an embodiment in which the driving housing 10 of the disclosed technology is or includes a motor housing, the power of the water bike may be obtained by the motor. The driver driving the water bike may rotate the circular wing 11 of the driving housing 10 by the motor without pressing down the pedals 130. Here, the output gear 20 of the bevel gear rotates by the rotation of the circular wing 11, and thus the screw propeller 150 may finally rotate to allow the driver to drive the water bike without feeling physical fatigue (an automatic driving mode). A user interface for commanding an on/off operation of the motor is provided. Also, in another example, the driver may press down the pedals 130, and a sensor for recognizing the rotation of the pedals may be disposed on the water bike, and the motor may be driven by the detection the sensor so that the driving housing 10 rotates.

The driver driving the water bike may use his body force as the power for the water bike. Here, the motor of the driving housing 10 is not driven. Power generated through the rotation of the pedals 130 may be transmitted to the belt pulley 18 of the driving housing 10 through the power transmission assembly 140 of the water bike. When the belt pulley 18 rotates, the circular wing 11 of the driving housing 10 that is integrated with the belt pulley 18 may rotate to finally rotate the screw propeller 150. Thus, the driver may drive the water bike while enjoying physical exercise (a manual operation mode).

In another implementation of the disclosed technology, the transmission may be disposed in the driving housing 10 instead of the motor. When the transmission is installed, a gear ration may be changed in the manual operation mode to provide an optimal environment to the driver of the water bike depending on conditions.

VARIOUS EXAMPLES

1. The body frame 110 of the disclosed technology may be variously changed in terms of shape and structure without departing from the scope of the disclosed technology. To ensure structural strength and stability of the body frame 110, or to achieve a function of the support set 114 disposed on the body frame 110, various structural modification or addition may be performed on the body frame 110.

2. In some implementations, various gears used in the disclosed technology may be provided with metal members. Also, the body frame 110, the driver chair 120, the handles 161 and 162, and the support set 114 may include rigid metal members or plastic members.

3. Although not shown, a user interface may be installed for convenience in driving of the water bike 100. The user interface may be or include a mechanic or electronic device. For example, the user interface may be provided to allow a user to input information as to whether the motor or the transmission is selected or not.

4. The floating body of the disclosed technology may be variously changed in size, however, preferably, the floating body may have a radius of about 300 mm, about 350 mm, about 400 mm, about 500 mm, or about 600 mm. The floating body may be formed of or include a foam material and have an outer circumferential surface thereof that is coated with a coating material such as epoxy or urethane so as to improve durability.

5. The coupling hole 101 defined in the floating body 101 (102 and 103) may have a depth that is defined as an opening (through hole) passing through the center P of the floating body 101 to the opposite side of the floating body. Thus, the coupling hole 101*a* may have a depth corresponding to a diameter of the floating body 101. Each of the connection rods 111, 112, and 113 may pass through the center P of the floating body along the coupling hole 101*a* to protrude to the opposite side. Here, a flange type cap may be coupled to the protrusion to more firmly couple the body frame 110 to the floating body 101.

6. The input gear of the circular wing 11 of the disclosed technology may be disposed toward the housing body 15 as illustrated in FIGS. 7 and 9. The belt pulley 8 may be disposed at an opposite side of the input gear of the circular wing 11. However, in another embodiment, the integrated structure of the driving housing 10 may be changed. For example, although the input gear of the circular wing 11 is disposed toward the housing body 15, the housing body 15 may be disposed between the circular wing 11 and the belt pulley 18 and thus be integrated with the circular wing 11 and the belt pulley 18.

The protective scope of the disclosed technology will not be limited to the descriptions and expressions of the foregoing embodiments that are clearly described above. Moreover, the protective scope of the disclosed technology will not be limited due to modification or substitution which is well-known to those who is ordinary skilled in the art.

The invention claimed is:

1. A water bike using a floating body, the water bike comprising:

a plurality of floating bodies each of which has a spherical shape or a sphere-like shape, wherein one of the plurality of floating bodies is disposed at a front side of the water bike in a forward advancing direction of the water bike, and two of the plurality of floating bodies are disposed at a rear side of the water bike;

a body frame configured to connect the plurality of floating bodies to one another, wherein the body frame connects the plurality of floating bodies by using three connection rods that are respectively attached to or detached from the floating bodies along a direction toward centers of the plurality of floating bodies;

a driver chair disposed over the body frame;

handles configured to manipulate a moving direction of the water bike and connected to a rudder that is disposed at a rear side of the water bike;

pedals disposed on the body frame adjacent to the floating body that is disposed at the front side to provide a driving force so that the water bike moves forward;

a cylindrical housing including a motor and disposed under the driver chair and over the body frame; and a power transmission assembly for rotating a screw propeller that is disposed under the body frame in the water by using a driving force generated by the pedals or the motor, wherein the power transmission assembly rotates the screw propeller through a bevel gear that is coupled to and engaged with an input gear arranged on a circumference portion of the cylindrical housing.

2. The water bike of claim 1, wherein the connection rods of the body frame are attached to or detached from the floating bodies by a screw-rotation.

3. The water bike of claim 1, wherein the driver chair is disposed over the body frame on a line that intersects a center (Q) of a virtual line connecting centers of the two floating bodies disposed at the rear side, and the driver chair is disposed adjacent to the rear side of the body frame.

4. The water bike of claim 1, wherein the handles that are respectively positioned at left and right sides with respect to the driver chair are connected to a rotation member that rotates on a surface of a chair rod supporting the driver chair.

5. The water bike of claim 1, wherein the circumference portion has a circular wing shape.

6. The water bike of claim 1, wherein the cylindrical housing includes a metal member.

7. A water bike using a floating body, the water bike comprising:

a plurality of floating bodies each of which has a spherical shape or a sphere-like shape, wherein one of the plurality of floating bodies is disposed at a front side of the water bike in a forward advancing direction of the water bike, and two of the plurality of floating bodies are disposed at a rear side of the water bike;

a body frame configured to connect the plurality of floating bodies to one another, wherein the body frame connects the plurality of floating bodies by using three connection rods that are respectively attached to or detached from the floating bodies along a direction toward centers of the plurality of floating bodies;

a driver chair disposed over the body frame;

handles configured to manipulate a moving direction of the water bike and connected to a rudder that is disposed at a rear side of the water bike;

pedals disposed on the body frame adjacent to the floating body that is disposed at the front side to provide a driving force so that the water bike moves forward; a cylindrical housing including a transmission and disposed under the driver chair and on the body frame; and a power transmission assembly for rotating a screw propeller that is disposed under the body frame in the water by using a driving force generated by rotation of the pedals or rotation of a motor, wherein the power transmission assembly rotates the screw propeller through a bevel gear that is coupled to and engaged with an input gear arranged on a circumference portion of the cylindrical housing.

8. The water bike of claim 7, wherein the circumference portion has a circular wing shape.

9. The water bike of claim 1, wherein the cylindrical housing includes a metal member.

10. A driving housing disposed over a water bike, comprising:

a cylindrical housing body in which a motor is disposed such that the driving housing functions as a motor housing;

a belt pulley around which a driving belt is wound, the belt pulley being integrated with the housing body; and a circular wing integrated with the housing body, the circular wing having a diameter from a central line of the housing body in a longitudinal direction to an outer circumferential end of the circular wing, the diameter being greater than that from the central line to an outer surface of the housing body, wherein the circular wing radially protrudes from a surface of the housing body in a predetermined distance, and the circular wing comprises an input gear that is tooth-coupled to an output gear disposed under the circular wing to constitute a bevel gear.

11. The driving housing of claim 10, wherein the input gear of the circular wing is disposed toward the housing body, and the belt pulley is disposed at a side opposite to the input gear of the circular wing.

12. The driving housing of claim 10, wherein the input gear of the circular wing is disposed toward the housing body, and the housing body is disposed between the circular wing and the belt pulley.

13. The driving housing of claim 10, wherein the output gear that is tooth-coupled to the input gear of the circular wing is connected to a screw propeller of the water bike through a flexible shaft.

14. The driving housing of claim 10, wherein the water bike is automatically driven by a rotation force of the motor in the housing body or manually driven by a rotation force that is generated by rotation of pedals disposed at a front side of the water bike and transmitted through the driving belt that is wound around the belt pulley.

15. A driving housing disposed over a water bike, comprising:

a cylindrical housing body in which a transmission is disposed such that the driving housing functions as a transmission housing;

a belt pulley around which a driving belt is wound, the belt pulley being integrated with the housing body; and a circular wing integrated with the housing body, the circular wing having a diameter from a central line of the housing body in a longitudinal direction to an outer circumferential end of the circular wing, the diameter being greater than that from the central line to an outer surface of the housing body, wherein the circular wing radially protrudes from a surface of the housing body in a predetermined distance, and the circular wing comprises an input gear that is tooth-coupled to an output gear disposed under the circular wing to form a bevel gear.

16. The driving housing of claim 15, wherein the input gear of the circular wing is disposed toward the housing body, and the belt pulley is disposed at a side opposite to the input gear of the circular wing.

17. The driving housing of claim 15, wherein the input gear of the circular wing is disposed toward the housing body, and the housing body is disposed between the circular wing and the belt pulley.

18. The driving housing of claim 15, wherein the output gear that is tooth-coupled to the input gear of the circular wing is connected to a screw propeller of the water bike through a flexible shaft.

* * * * *